United States Patent [19]

Didion

[11] Patent Number: 4,981,581

[45] Date of Patent: Jan. 1, 1991

[54] DUST COLLECTION HOOD FOR SAND RECLAIMER, COOLING, AND BLENDING ROTARY DRUM

[75] Inventor: Charles J. Didion, St. Charles, Mo.

[73] Assignee: Didion Manufacturing Co., St. Peters, Mo.

[21] Appl. No.: 394,870

[22] Filed: Aug. 17, 1989

[51] Int. Cl.[5] ..... B07B 9/00; B07B 4/06

[52] U.S. Cl. ..... 209/28; 209/138; 209/152

[58] Field of Search ..... 209/2, 133, 138, 139.1, 209/146, 152, 153, 28, 29, 44.2, 44.3, 36, 37, 21, 22; 241/24, 79, 79.1

[56] References Cited

U.S. PATENT DOCUMENTS

| | | | |
|---|---|---|---|
| 138,019 | 4/1873 | Guilder | 209/29 |
| 150,578 | 5/1874 | Hunter | 209/28 |
| 311,808 | 2/1885 | Butler et al. | 209/28 |
| 1,828,247 | 10/1931 | Forster | 209/37 |
| 3,998,262 | 12/1976 | Didion | 164/131 |
| 4,050,635 | 9/1977 | Mueller et al. | 241/24 |
| 4,566,637 | 1/1986 | Deve | 241/24 X |

*Primary Examiner*—Donald T. Hajec
*Attorney, Agent, or Firm*—Paul M. Denk

[57] ABSTRACT

A dust collecting hood for use in conjunction with a sand cooling, blending, reclaiming of other rotary drum, within the casting industry, the hood incorporates an upper and lower section, either of unitary or separate construction, the upper section including a discharge opening which cooperates with a vacuum pump to draw air through the hood, and the proximate discharge end of the rotary drum, while the lower section of the hood provides a discharge opening for removal of the mold sand from the drum, the hood, at this collection location, while further incorporating ports through which air may pass for forming the air curtain across the associated hood and drum, for removal of said fines, dust, and other deleterious particles from the ambient air.

9 Claims, 3 Drawing Sheets

DUST COLLECTION HOOD FOR SAND RECLAIMER, COOLING, AND BLENDING ROTARY DRUM

BACKGROUND OF THE INVENTION

This invention relates to a rotary drum, used in the casting field, and having major application for the treatment of mold sand, as to achieve its reclaiming, cooling, blending, or separation from the castings, but in this particular instance, incorporates hood means having predesigned passages for diverting air around the approximate discharge end of the drum, for the elimination of dust and sand fines that accumulate thereat, for their discharge and collection or disposal.

There are a variety of prior patents that have been obtained upon various style of rotary drums for use in the casting industry. For example, one of the early embodiments is that which is shown in the U.S. Pat. No. 3,998,262, to Charles J. Didion, the inventor of the development described herein, showing a casting shakeout unit and method of operation. Essentially, such a drum is arranged upon its structural support, rotated by means of drive means, so that when castings clogged with mold sand as directly obtained from the site of their casting, are then passed through the shown rotary drum, the mold sand is effectively separated and removed from the prepared castings, to achieve the required separation without necessitating the employment of any labor to attain such results.

In addition, another patent to Charles J. Didion, U.S. Pat. No. 4,674,691, shows a related type of rotary drum, of the type used for sand reclaiming, wherein the type of sand removed by the apparatus as shown in the U.S. Pat. No. 3,998,262, is further processed, separated, all in preparation for its reusage in the casting industry. In any event, and regardless which rotary type drum may be employed for achieving their intended results, as described in said patents, there is always the associated problem with the generation of excessive dust, and sand fines, that have a tendency to enter into the air stream, and need to be removed in order to adequately assure the safety and health of the worker, and also to comply with various government regulations.

The usage of shrouds or hoods around the discharge end of a drum has been employed in the prior art, as can be seen in the U.S. Pat. No. 4,050,635, to Mueller, et al, wherein the shown housing incorporates an outlet chute, at its lower end, for attaining the discharge of the castings, or its sand, therefrom, during operations of the shown device. In addition, such hoods have been used for collection and removal of sand particles, to facilitate the collection of the sand in preparation for its reusage. But, the usage of a ventilating hood, which has various ventilating ports designed therein so as to accommodate the flow of air around and through the discharge end of the rotary drum, for the removal of heat from sand and containment of fines and dust, while likewise diverting the separated mold sand for passage to a discharge opening, as arranged at the bottom of the ventilating hood, apparently has not been done previously.

SUMMARY OF THE INVENTION

The principle object of this invention is to provide a ventilating hood for use for dust collecting, and for effecting fines removal and cooling, preferably at the approximate discharge of a rotary drum, of the type used in the foundry casting industry.

This invention contemplates the formation of a ventilating hood, for use in conjunction with a rotary drum of the type, as previously explained, employed in the casting industry and for use for removal of mold sand, from their castings, or the separation and grading of the mold sand, for purposes of its reclaiming, in preparation for its reusage. The rotary drum is of the type that is an elongated structure, generally having an outer cylindrical shell, with various grading screens or perforated cylinders provided internally thereof, in order to properly handle the castings that may be passing therethrough, or the separated sand that will have previously been removed from the said castings, to provide for a separation of the sand, its grading, and its conveyance in various directions for collection and removal, in many instances, in preparation for its reusage. But, as can be readily understood, the processing of sand and castings in the aforesaid manner does generate an excessive amount of dust, sand fines that become entrained in the atmosphere, and which preferably must be removed for the health of the workers, the sanitation of the near vicinity of the plant, and also which fines may be diverted and collected, itself, for reusage in the casting of additional iron or other metallic parts. Such a drum is normally rotated at a specified speed by means of a drive package, normally incorporating one or more heavy duty or horsepower motors, in combination with a speed reducer, for providing that degree of rotation for the drum for achieving the intended results during its application. This has already been described and analyzed, in addition to having been patented, in the prior art, as aforesaid.

The current invention incorporates at the approximate discharge end of the rotary drum a dust collecting hood, to achieve the intended purposes as previously explained, and to attain its desirable objectives to eliminate the hazards that are associated with permeation of sand fines and dust from circulating within the atmosphere within a plant. The hood is fabricated in the shape of a shroud for surrounding at least the approximate discharge end of the rotary drum, and is normally fabricated, for the convenience of construction and installation, in two sections, comprising an upper section and a lower section, with the lower section containing a series of vent ports, which are custom designed to provide for the entrance of air into the hood, at select locations, while simultaneously diverting any casting sand falling into the lower section downwardly towards a discharge opening arranged approximately centrally at the lowest segment of the fabricated hood. Proximate each air venting port contained within the lower section, as explained, there is incorporated an associated deflection plate, which provides for the guidance and direction of the falling sand downwardly towards the sand discharge of the hood, to provide for its collection or removal, while simultaneously allowing the air to be attracted into and through the said ports, and rising upwardly into the upper section of the said hood, for the purpose of attracting and accumulating the dust and sand fines generated at that location, for their entrainment within the passing air, and for further removal or collection. These vent ports provided within the lower section of the hood are arranged within the front and back walls of the said lower section, in addition to being arranged within the inclined side walls of the said hood.

The upper section of the hood contains an opening therethrough, and mounted in proximity with the opening, or communicating through duct work with the opening, is a vacuum pump which is designed to provide for a reduced pressure for creating means for attracting air, particularly that air in which the dust and sand fines are entrained, so as to achieve their removal, and prevent them from entering into the ambient air around the discharge end of the rotary drum. The upper section may be opened, internally, to achieve a straight attraction of air through the perforated discharge end of the rotary drum, to form a type of air curtain or screen, or the upper section may likewise contain an internal wall, that is configured to the same or equivalent shape of the rotary drum contiguously thereof, to provide a clear entranceway at approximately the midpoint, laterally of the rotating drum, between the upper and lower sections, and into which the air containing the dust and sand fines permeates for attracting the dust by means of the vacuum pump to a position of discharge and removal. On the other hand, where the upper section does not contain any internal wall, the entire apparatus functions generally in the formation of an air type curtain, as aforesaid, that rises from the lower segment of the hood towards its upper section, through its air passage and opening provided thereat, for attracting the dust and sand fines from entirely across the discharge end of the rotary drum, to attain their removal, as aforesaid.

It is, therefore, the principal object of this invention to provide a ventilating hood arranged in cooperation with the discharge end of a rotary drum, as used in the casting industry, for removal of dust and other impurities from the ambient air.

Another object of this invention is to provide a segmented ventilating hood, for use for dust collecting, and which may be fabricated and arranged into position in proximity with the discharge end of a rotary drum, as employed in the casting industry.

A further object of this invention is to provide a dust collecting hood that contains design arranged and patterned air entering ports within its lower segment, located at strategic locations, so as to form an air curtain across and through the discharge end of a rotary drum, for removal of any impurities entrained within the ambiant air when passing through the said drum during its functioning.

Yet another object of this invention is to provide means for cleansing of the air exiting from a rotary drum during its processing of sand, or its separation from castings.

Still another object of this invention is to provide means for maintaining compliance with government regulations relating to the discharge of impurities into the atmostphere, particularly within an operating plant in order to maintain the health and safety of its workers.

Still another object of this invention is to provide means for ventilation of air, dishcarging from a rotary drum used in the casting industry, and achieve such with a minimum of employed labor.

Another object of this invention is to provide a dust collecting hood which may form either an air curtain across a discharge end of a rotary drum, or provide a path of flow for air into and through a hood, primarily for collecting of dust and removal of sand fines from its proximate atmosphere.

These and other objects may become more apparent to those skilled in the art upon reviewing the summary of this invention, and upon undertaking a study of the description of its preferred embodiment, in view of the drawings.

BRIEF DESCRIPTION OF THE DRAWINGS

In referring to the drawings, FIG. 1 provides a side view of dust collecting hood of this invention as employed proximate the discharge end of a rotary drum.

DESCRIPTION OF THE PREFERRED EMBODIMENT

Figure 1:
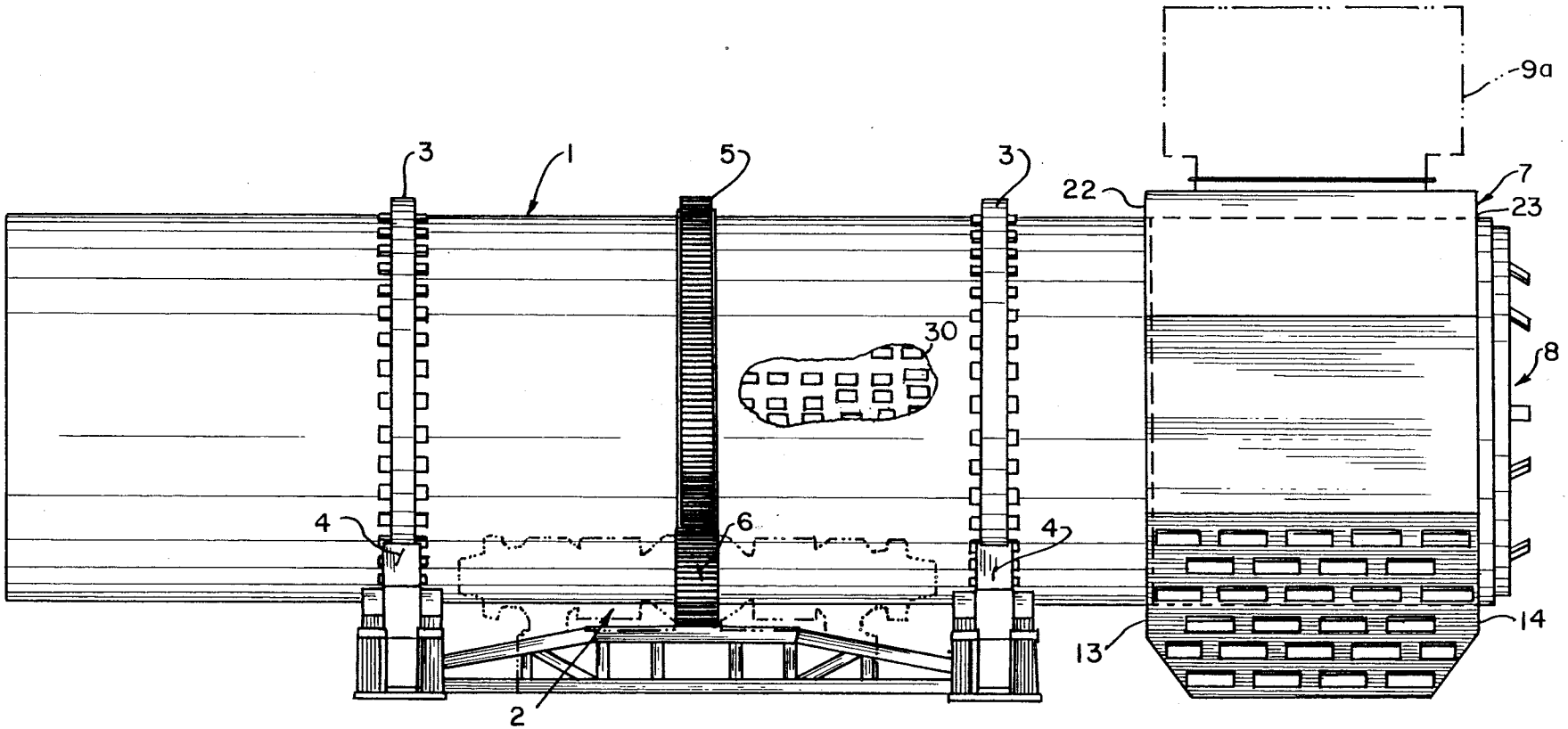
Figure 3:
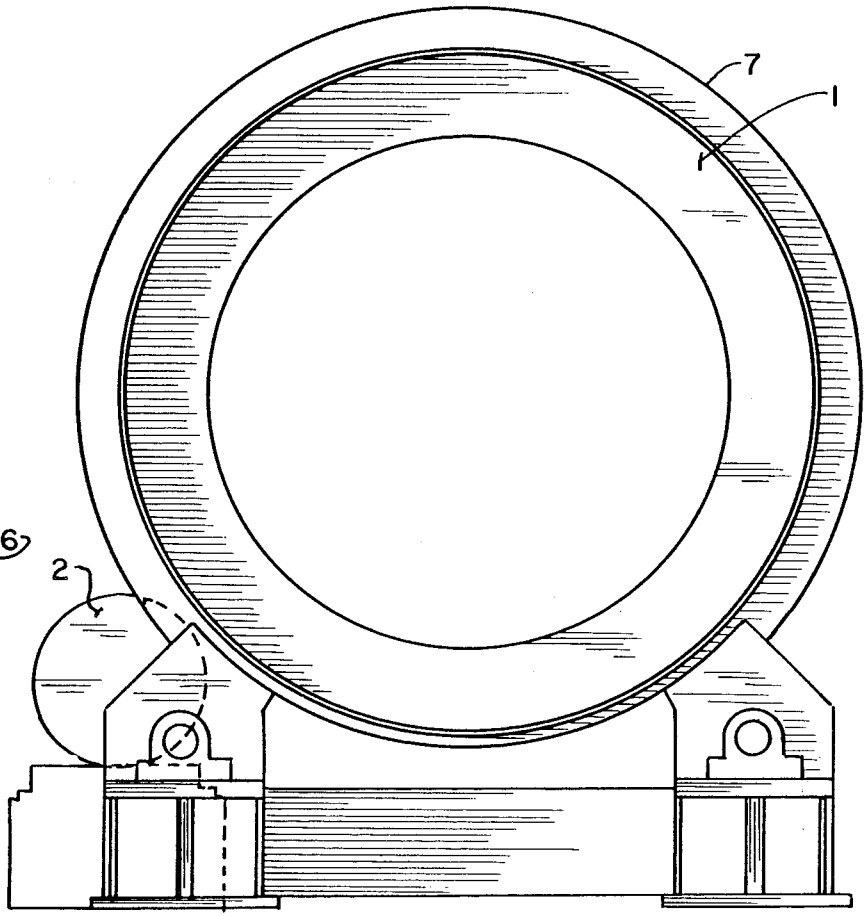
FIG. 3 is a entrance end view, taken from the left side, of the rotary drum and ventilating hood disclosed in FIG. 1.

In referrring to the drawings, FIG. 1 discloses the casting shake out or sand reclaiming rotary drum 1 of this invention, of the type, as shown in the prior art, which provides for its rotation through the functioning of its drive package means 2 which may include one or more drive motors, in combination with gear and speed reducers, for providing for a controlled rotation of the rotary drum, to achieve its intended results. This has been reviewed in the prior art. Such a drum incorporates guide means, as at 3, around its perimeter, or circumference, and which provides rails for the rollers 4 to ride upon in the roller mounting for furnishing the rotation of the drum 1. Likewise, gear means 5 is provided around the circumference of the drum, and cooperates with the drive gear 6, which is driven by the drive package 2, in the manner as known in the art. The drum may have a screen segment 30 for the separation or blending of the processed sand.

The ventilating hood 7 of this invention is shown mounted surrounding the approximate discharge end 8 of the rotary drum, and the hood is maintained stationarily supported, while the drum 1 rotates therein. Mounted upon the hood 7 is means for drawing a capacity of air, such as a vacuum pump, as at *9a*, and which may be either mounted directly upon the hood 7, or communicate with duct work associated therewith, to attain its results, as to be subsequenty analyzed.

Such a vacuum pump may be of the type that may be obtained from a company such as American Air Filter Company, of Louisville, Ky., and is generally identified in the art as a Roto Clone model. In the alternative, the vacuum pump may be a dust collector of the pulsating bag type, which when in operation, attracts air and the dust fines into the vicinity of its fabric bag, and then periodically provide for its discharge downwardly, as in this particular instance, for collection with the other mold sand that is being accumulated through the functioning of the dust collection hood of this invention. These type of dust collectors may operate in conjunction with a motor, or vacuum pump, generally are in the vicinity of 15 horsepower capacity, and are usually rated for a 350 tons per hour, with surges up to 400 tons per hour, in the attraction and movement of air therethrough, as for use for dust collection purposes. The dust collection requirements to be met by the pumps as employed in combination with this hood may draw approximately 12,000, and up to as great as 22,000, cubic feet of air per minute, at the intake or left side of the drum 1, and draw such capacity of air through the drum, upwardly within its hood portion, for attraction of the dust and any sand fines entrained therein, for their collection and removal.

As can be seen in FIGS. 2 through 5, the dust collecting and ventilating hood 7 of this invention is fabricated in two segments, comprising an upper section 9 and a lower section 10. The segmented sections of the hood are designed for reasons of practicality, because the hood may be of ample size, anywhere from 6 to 12 feet in diameter, or greater, for surrounding the approximate discharge end of the corresponding and cooperating rotary drum 1. Each section of the hood includes flanged portions, as at 11 and 12, respectively, and which may be bolted or otherwise secured together, when the hood sections are brought into assembly, for functioning at the proximate end of the internally and concentrically aligned rotary drum 1. Obviously, the hood could be of unitary construction. The lower section 10 of the hood includes a front and a back wall, as at 13 and 14, and additionally incorporates a pair of side walls 15 and 16, each of which side walls and front and back walls may have inclined portions, as can be seen generally at 17, to provide for guidance and direction of any casting sand passing through the proximate perforated or screened end of the rotary drum to be diverted downwardly, and towards a discharge opening, as at 18, provided within and through the bottom wall 19 of the fabricated hood. Obviously, such an arrangement provides for the direction of the mold sand, separated at said location of the drum, to be deposited downwardly, as for falling upon a conveyor, or into a collection bin, where the sand can then be processed for reuse in the casting industry, in a manner as known in the art. Generally, the processing of sand and castings within such a drum is readily disclosed in my prior U.S. Pat. No. 3,998,262, wherein inner apertured cylinder or sectionalized surfaces are used to screen out the sand from the castings during shake-out, and which operation, and apparatus used for its achievement, as identified in my earlier patent, is incorporated herein by reference.

Figure 4:
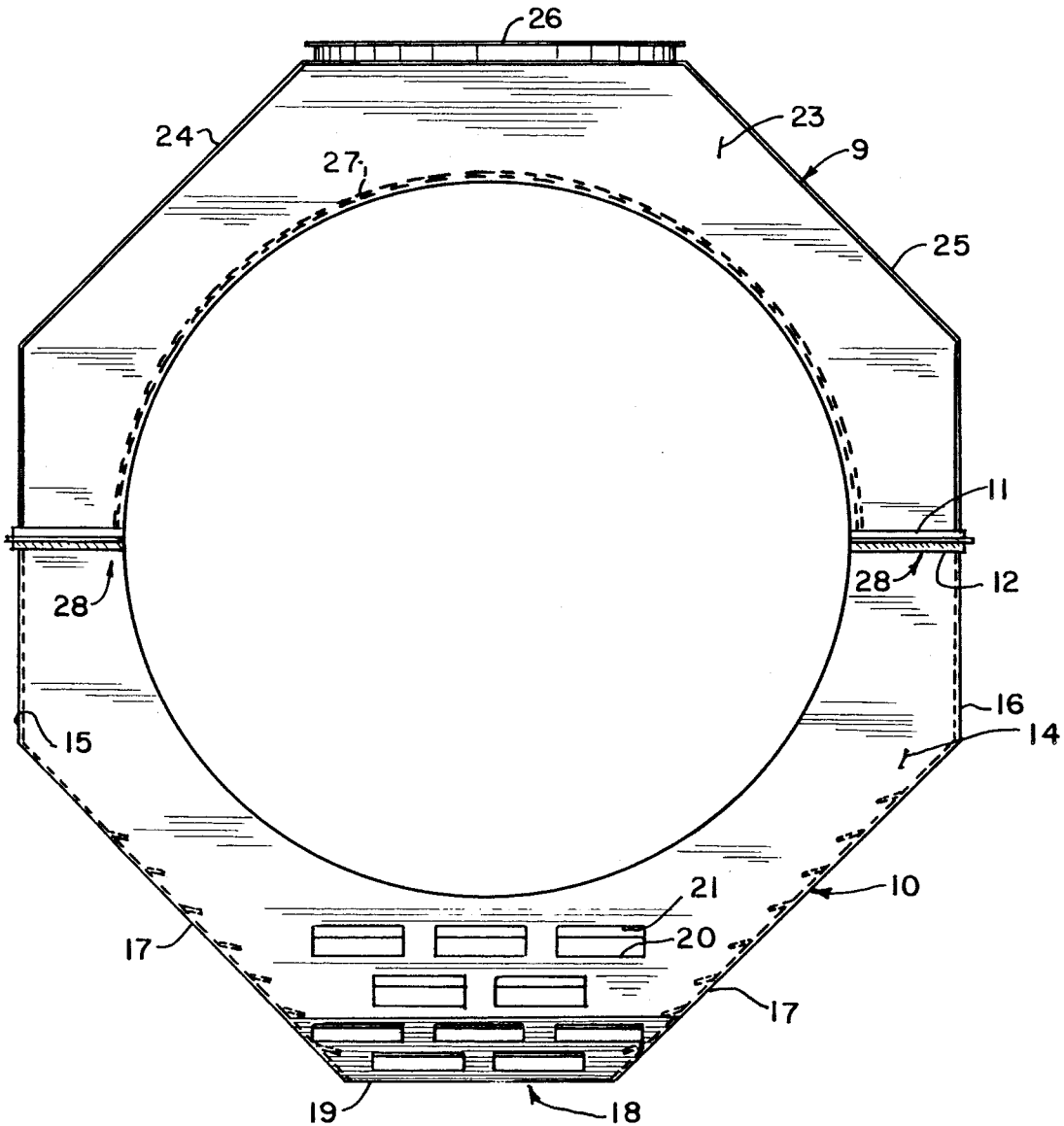
FIG. 4 is an end view of the dust collecting hood of this invention, as employed in association with a rotary casting drum.

In addition, with this type of activity being performed within the rotary drum at the location of its discharge end, and for that matter, throughout the entire length of the drum, in the processing of sand, either for reclaiming purposes, or for its removal from castings, a significant quantity of dust, sand fines, and other deleterious particles become entrained within the ambient air passing though this end of the rotary drum. As a result, it has been found desirable to provide means for removal of such deleterious particles from the atmosphere, before it attains entrance into the factory, plant, or the like, in which this rotary drum functions. Thus, the bottom section 10 of the hood incorporates a series of designed ports, as at 20, and through which the flowing air attracted by the vacuum pump **9*a* may be drawn, to provide for its passage upwardly, through the proximate discharge end of the rotary drum, for attracting the dust and sand fines upwardly towards the pump for their removal. In addition, provided across the upper section of each port 20 is a deflection plate, as at 21, which may be bent from the formed ports 20, or welded thereat, and which are inclined slightly downwardly, so that any casting sand which falls thereon will be diverted downwardly, prevented from exiting from the port 20 arranged just below thereof, to assure that all of the sand as separated and screened will attain a movement and flow downwardly towards the main discharge opening 18, to be removed from the hood at said location. In addition, as can be seen in FIG. 4, the front and back walls 13 and 14 likewise contain related type of ports 20, and corresponding deflection plates 21**, to attain the same purpose as just explained.

The upper section 9 of the dust collecting or ventilating hood 7 also surrounds in contiguity the upper half of the rotary drum 1, as can be seen. This particular section includes its series of walls, comprising the front and back walls 22 and 23, in addition to the side walls 24 and 25, that function as a shroud to provide for the convenient diversion of the air attracted through the hood, and having the sand fines and dust entrained therein, towards the upper opening 26 to attain a removal of such deleterious particles from the hood, the rotary drum, and the ambient air, in a desired fashion. The vacuum pump **9*a*, as aforesaid, may either mount directly upon the opening 26**, or perhaps communicate with a conduit that connects therewith, to achieve that removal of the particle laddened air from the rotary drum at this location.

The upper section 9 of the hood may, or may not, contain an interior wall, as at 27. Where such a wall is provided, as around the periphery of the rotary drum 1, it provides entrance ports laterally, as at 28, into the upper section of said hood, for attracting the particle laddened air therein, through the upper section of the hood, and out of the discharge opening 26. Thus, the sand fines and dust will generally be collected from the lower segment of the rotary drum, generally below its midpoint, in a manner as can be understood. On the other hand, where the upper section 9 of the hood does not contain an interior wall 27, in the manner as defined, then the attraction of the air by means of the vacuum pump 9 will generally provide a form of air curtain directly through and across the entire opening of the rotary drum, which passes from the lower vents or ports 20, and the open discharge end of the drum, upwardly towards the air opening 26, to function as a screen for removal of dust particles and sand fines from the ambient air, passing entirely through the rotary drum, for removal and collection. As can also be seen in FIG. 5, it is desirable because of the significant size of this ventilating hood that various reinforcement may be required in the select sections of the hood, and such reinforcement can be seen at 29, to provide structural bracing for the various sections, and provide ample stability for the ventilating hood, when installed, and subjected to the significant vibrations and movements of the rotary drum contained therein, during operations of this device.

Figure 2:
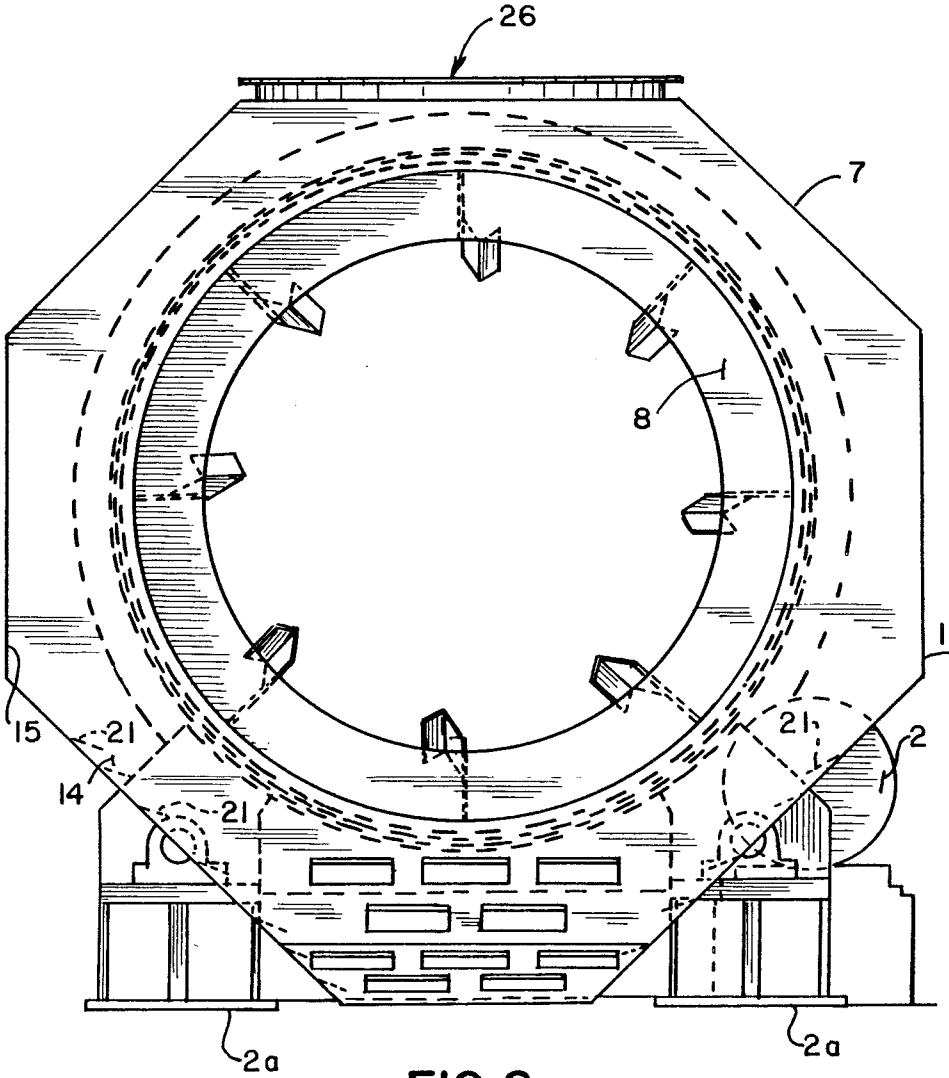
FIG. 2 is an end view of the drum and hood as shown proximate the discharge end for the design as disclosed in FIG. 1.
Figure 5:
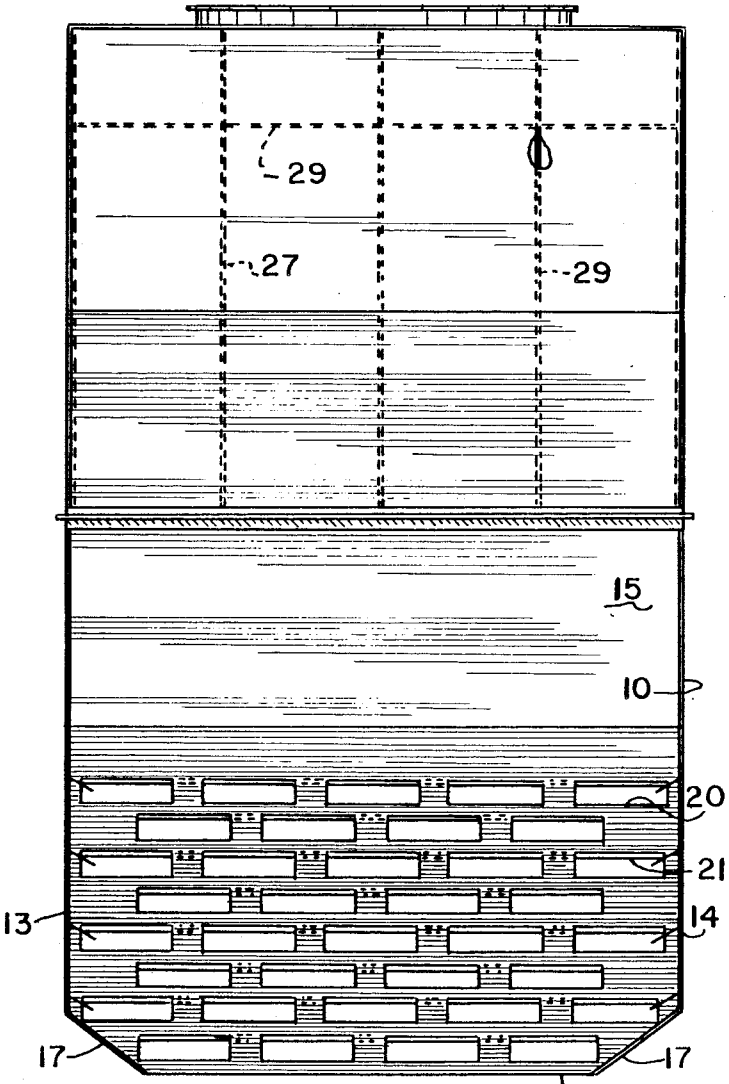
FIG. 5 is a side view of just the dust collecting hood of this invention.

To further add stability to the dust collecting hood of this invention, it can be seen, as in FIG. 2, that the lowermost segment of the lower section 10 of this hood, at the proximate location of its discharge opening 18, may rest upon a surface, such as the supporting ground, to provide it with stability. Obviously, though, when such is the case, space or an opening will need to be provided therebelow for the discharge opening 8, to allow the mold sand to fall therefrom, for its removal and collection.

Upon review of the subject matter of this invention, as analyzed in this application, it should become apparent that a significant improvement through the usage of this invention is to provide the ability within a sand reclaimer to increase the CFM of air through the unit without removing excess amounts of fines and sand material. Obviously, it is desirable to leave this type of material within the unit, for collection and reusage. It is common within the hood of this particular arrangement that the unit can double the amount of CFM of air passing through it, because of its design, in relation to other types of hoods that are currently available. In addition, because of the enhanced air flow that can be attained through this unit, it has the ability to integrate much more air around the sand, to expose the hot sand to a cooling medium, in order to facilitate a much more efficient and rapid cooling of the hot sand as passing through the unit.

Variations or modifications to the structure of this invention may occur to those skilled in the art upon reviewing the disclosure provided herein. Such variations or modifications, if within the spirit of this invention, are intended to be encompassed within the scope of any claims to patent protection issuing upon this development. The description of the preferred embodiment provided herein is set forth primarily for illustrative purposes only.

Having thus described the invention what is claimed and desired to be secured by Letters Patent is:

1. In a dust collection hood for use in conjunction with a rotary drum for use for sand cooling, blending, and reclaiming, wherein an elongated drum is rotated to provide for processing of mold sand as used in foundry casting while allowing for the collection of dust and sand fines, the improvement which comprises, said drum being of the type having an entrance end for delivery of the sand thereto, a screening segment, and a discharge end for the drum, a collection hood disposed in proximity with the said discharge end of the drum and arranged concentrically surrounding the same, said hood formed having an upper section and a lower section, said lower section incorporating a discharge opening approximately centrally and lowermost thereof and arranged for allowing the sand passing through the drum to discharge therefrom, said upper section incorporating a central opening therein and providing a flow path through the said upper section of the hood for conveyance of the dust and sand fines therethrough and to the means for drawing the reduced pressure, said discharge opening of the lower section and the central opening of the upper section being diametrically arranged with respect to the rotary drum arranged therethrough through the said collection hood, a series of ports arranged laterally and upwardly through the lower section of said hood to allow passage of air therethrough during operations of the said drum and hood, each port incorporating a diversion plate in association with its port opening, whereby the mold sand is diverted towards the discharge opening within the lower section of the hood, while the air is drawn through the ports and attracted into the hood upper section and towards its central opening for removal of dust and sand fines from the said hood and proximate drum, said diversion plates preventing the discharge of sand from the ports, during operations of the hood and drum.

2. The invention of claim 1 and wherein said lower section of the collection hood having front, back and side walls, and select ones of said walls partially surrounding said drum, and said ports arranged through said side walls.

3. The invention of claim 2 and wherein said ports also provided through said front and back walls.

4. The invention of claim 3 and wherein said upper section and lower section of the hood having connection flanges, and said flanges securing together to consolidate said hood sections around the discharge end of the rotary drum.

5. The invention of claim 5 and wherein said means for drawing a reduced pressure comprising a suction pump, and said pump securing upon said hood at its upper section opening and when operating functioning to attract dust and sand fines thereto.

6. The invention of claim 3 and wherein said upper section has an interior opening between it and the drum.

7. The invention of claim 3 and including an interior wall formed upon the upper section of the hood and therein providing a flow path through the said section of the hood for conveyance of the dust and sand fines therethrough and to the means for drawing the reduced pressure.

8. The invention of claim 2 and wherein said side walls of the lower section being inclined downwardly towards the discharge opening.

9. In a dust collecting hood for use in conjunction with a rotary drum for use for sand cooling, blending, and reclaiming, wherein an elongated drum is rotated to provide for processing of mold sand as used in foundry casting while allowing for the collection of dust and sand fines, the improvement which comprises, said drum being of the type having an entrance end for delivery of the sand thereto, a screening segment, and a discharge end for the drum, a collection hood disposed in proximity with the said discharge end of the drum and arranged concentrically surrounding the same, said hood formed having an upper section and a lower section, said lower section incorporating a discharge opening approximately centrally and lowermost thereof and arranged for allowing the sand passing through the drum to discharge therefrom, a series of ports arranged laterally and upwardly through the lower section of said hood to allow for passage of air therethrough during operations of the said drum and hood, each port incorporating a diversion plate in association with its port opening, to prevent the discharge of sand through the ports, whereby the mold sand is diverted towards the discharge opening within the lower section of the hood, while the air is drawn through the ports and attracted into the hood upper section and towards its opening for removal of dust and sand fines from the said hood and proximate drum, said upper section of said hood having an opening therethrough and cooperating with means for drawing a reduced pressure to attract the dust and sand fines from the drum proximate its said discharge end for removal, an interior wall formed in the upper section of the hood and spaced from said opening therein for providing a flow path through the said upper section of the hood for conveyance of the dust and sand fines therethrough and to the means for drawing the reduced pressure.

* * * * *